US006964344B1

(12) United States Patent
Kim

(10) Patent No.: US 6,964,344 B1
(45) Date of Patent: Nov. 15, 2005

(54) DISPLAY TRAY AND RACK ASSEMBLY

(76) Inventor: Chang S. Kim, 4432 Carnes Rd., Roseburg, OR (US) 97470

( * ) Notice: Subject to any disclaimer, the term of this patent is extended or adjusted under 35 U.S.C. 154(b) by 201 days.

(21) Appl. No.: 10/672,023

(22) Filed: Sep. 26, 2003

(51) Int. Cl.[7] ..... A47B 73/00
(52) U.S. Cl. ..... 211/74; 211/162
(58) Field of Search ..... 211/74, 162, 59.2, 211/85.4, 183, 94.01, 43

(56) References Cited

U.S. PATENT DOCUMENTS 4,407,418 A * 10/1983 Brammer ..... 211/85.3
5,076,443 A 12/1991 Trulaske
5,197,610 A * 3/1993 Bustos ..... 211/59.2
5,645,176 A 7/1997 Jay
5,749,478 A * 5/1998 Ellis ..... 211/59.2
D401,436 S 11/1998 Jay
6,142,316 A * 11/2000 Harbour et al. ..... 211/59.2
6,325,221 B2 * 12/2001 Parham ..... 211/59.2
6,523,702 B1 2/2003 Primiano et al.
6,659,293 B1 * 12/2003 Smith ..... 211/59.2
6,843,382 B2 * 1/2005 Kanouchi et al. ..... 211/90.02

* cited by examiner

*Primary Examiner*—David Purol
(74) *Attorney, Agent, or Firm*—Robert E. Howard

(57) ABSTRACT

A tray and rack assembly for beverage containers. The assembly includes a rack subassembly and a tray subassembly slidingly engaging said rack member. The tray subassembly includes a pair of substantially parallel tray sidewalls, a tray floor extending between the lower edges of the tray sidewalls, at least one beverage container stop member extending at least partially between the outer ends of the tray sidewalls, and a tray pull member extending from the outer end of the tray. The rack subassembly includes a pair of substantially parallel rack sidewalls, and a rack floor extending between the lower edges of the rack sidewalls. Sliding attachment means are adapted to hold the tray subassembly in sliding contact with the rack subassembly and permit the tray subassembly to be extended from and inserted into the rack subassembly.

10 Claims, 3 Drawing Sheets

DISPLAY TRAY AND RACK ASSEMBLY

BACKGROUND OF THE INVENTION

The present invention relates to a display tray and rack assembly for canned or bottled beverages.

Canned or bottled beverages are often placed into refrigerated display cases at their point of sale. In one type of display case the beverages are placed into display racks, each of which is designed to hold a plurality of beverage containers. Such racks are placed inside the refrigerated display case where they rest on a support shelf. The shelf and tray are inclined downwardly toward the front of the refrigeration unit. As the beverage container at the front end of the display rack is removed by a customer, the remaining containers slide downwardly by the force of gravity so that the next container in line is positioned in the front end of the display rack. Such a display rack is described in U.S. Pat. No. 5,645,176. When such racks become depleted of beverage containers, they must be refilled. Refilling such racks is difficult as it requires reaching deep inside the refrigeration unit.

SUMMARY OF THE INVENTION

It is an object of the present invention to provide a beverage container display tray and rack that provides easy access for refilling.

The tray and rack assembly of the present invention includes a rack subassembly and a tray subassembly slidingly engaging said rack member.

The tray subassembly includes a pair of substantially parallel tray sidewalls, a tray floor extending between the lower edges of the tray sidewalls, at least one beverage container stop member extending at least partially between the outer ends of the tray sidewalls, and a tray pull member extending from the outer end of the tray floor.

The rack subassembly includes a pair of substantially parallel rack sidewalls, a rack floor extending between the lower edges of the rack sidewalls, a rear end wall extending between the rack sidewalls at their inner ends and abutting the rack floor, and a tray stop member extending slightly above the rack floor and between the rack sidewalls at their outer ends.

Sliding attachment means are adapted to hold the tray subassembly in sliding contact with the rack subassembly and permit the tray subassembly to be extended from and inserted into the rack subassembly.

DESCRIPTION OF PREFERRED EMBODIMENTS

Figure 1:
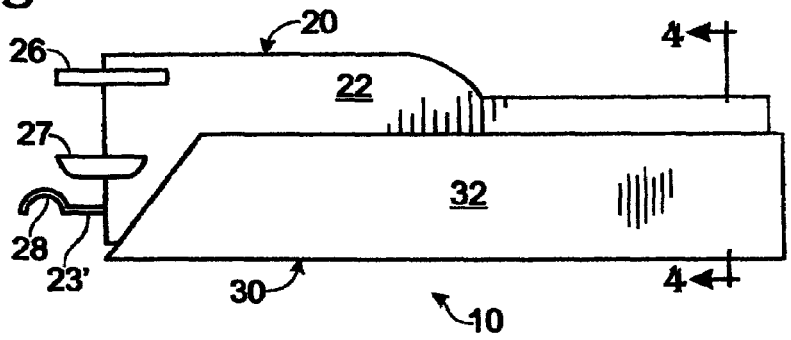
FIG. 1 is a right side elevation view of the tray and rack assembly of the present invention with the tray shown substantially fully inserted into the rack.

The tray and rack assembly 10 of the present invention includes a tray subassembly 20 and a rack subassembly 30.

Tray subassembly 20 includes right and left sidewalls 22 and 22', which are identical in shape and substantially parallel to each other. The height of each of right and left sidewalls 22 and 22' is greater in the front portion than in the rear portion, as shown. Tray subassembly 20 has no end walls.

A tray floor 23 extends between right and left sidewalls 22 and 22' adjacent their bottom edges, but removed therefrom, as shown. That portion of the sidewalls 22, 22' extending below tray floor 23 form a pair of legs.

Tray floor 24 has a plurality of longitudinal rails 24 extending from the upper surface thereof. Rails 24 are substantially parallel to each other and to right and left sidewalls 22 and 22'. Tray floor 24 also has a plurality of circular weep holes 25 extending therethrough. Rails 24 and weep holes 25 have not been shown in FIG. 6 for sake of clarity.

Figure 6:
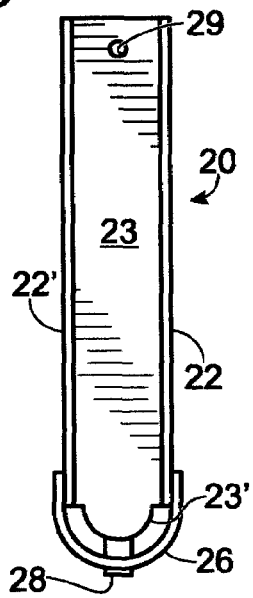
FIG. 6 is a top plan view of the tray subassembly of the present invention.
Figure 7:
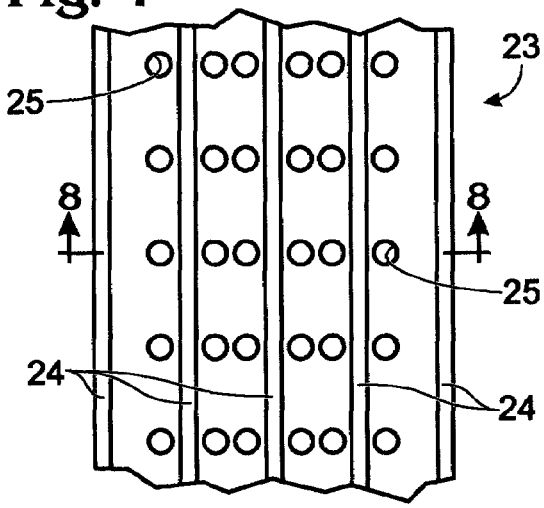
FIG. 7 is an enlarged partial plan view of the floor of the tray subassembly of the present invention.
Figure 8:
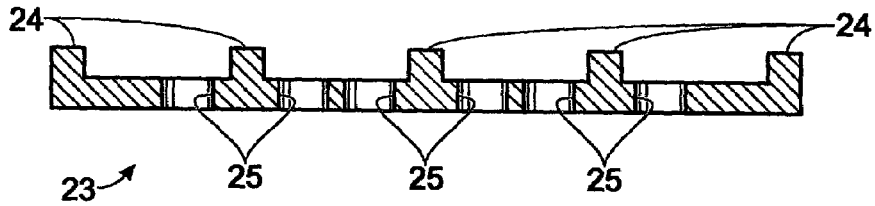
FIG. 8 is an elevation view of the floor of the tray subassembly of the present invention taken along line 8—8 of FIG. 7.
Figure 9:
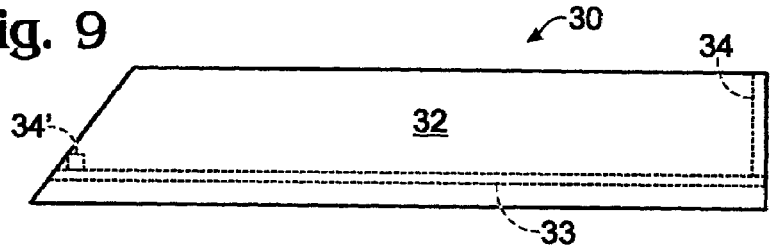
FIG. 9 is a right side elevation view of the rack subassembly of the present invention.
Figure 10:
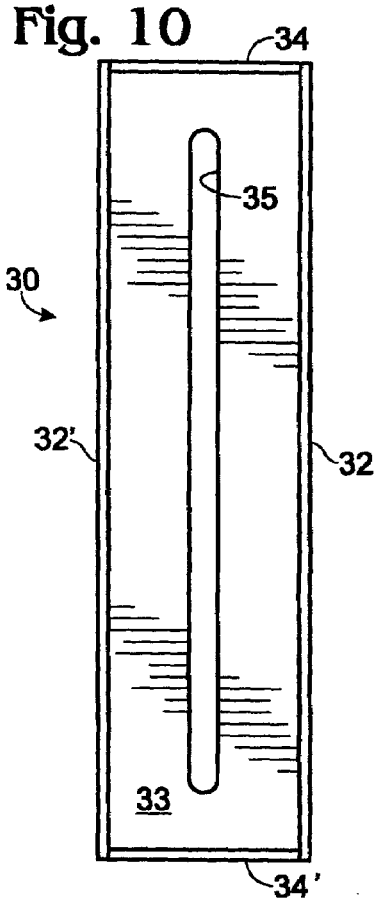
FIG. 10 is a top plan view of the rack subassembly of the present invention.

Upper stop member 26 is circular or arcuate in shape, as best seen in FIG. 6. Right and left intermediate stop members 27 and 271 are also circular or arcuate in shape.

Curved tray pull member 28 extends upwardly from the outer edge of an extension 23' of floor 23. Extension 23' is circular or arcuate, as best seen in FIG. 6.

A sliding attachment opening 29 extends through tray floor 23, as seen in FIG. 6.

Rack subassembly 30 includes right and left sidewalls 32 and 32', which are identical in shape and substantially parallel to each other.

A rack floor 33 extends between right and left sidewalls 32 and 32' adjacent their bottom edges, but removed therefrom, as shown.

A rear end wall 34 extends between the inner edges of right and left sidewalls 32 and 32', and abuts rack floor 33.

A tray stop member 34' extends between the front edges of right and left sidewalls 32 and 32', and slightly above the upper surface of rack floor 33.

A longitudinal slot 35 extends through rack floor 33 substantially at its mid-portion and for substantially the length of rack floor 33.

Figure 2:
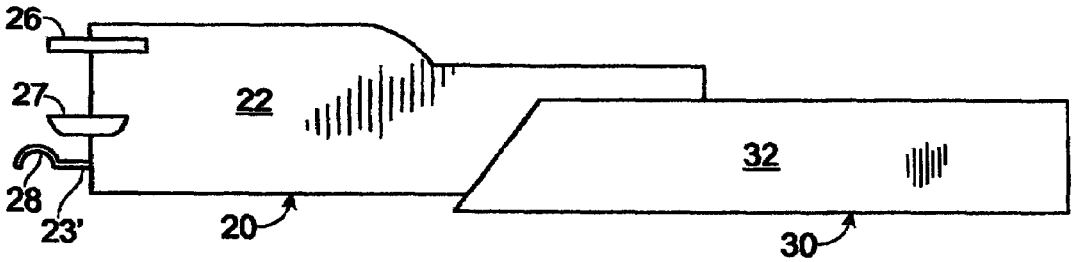
FIG. 2 is a right side elevation view of the tray and rack assembly of the present invention with the tray shown substantially fully extended out of the rack.
Figure 3:
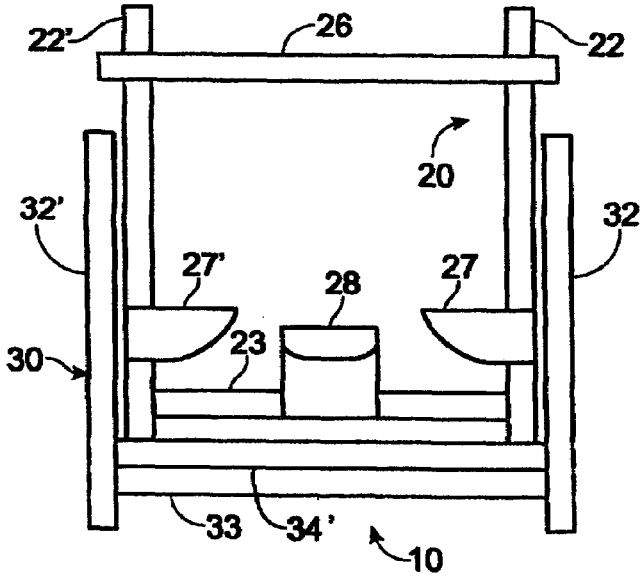
FIG. 3 is a front elevation view of the tray and rack assembly of the present invention with the tray shown fully inserted into the rack.
Figure 4:
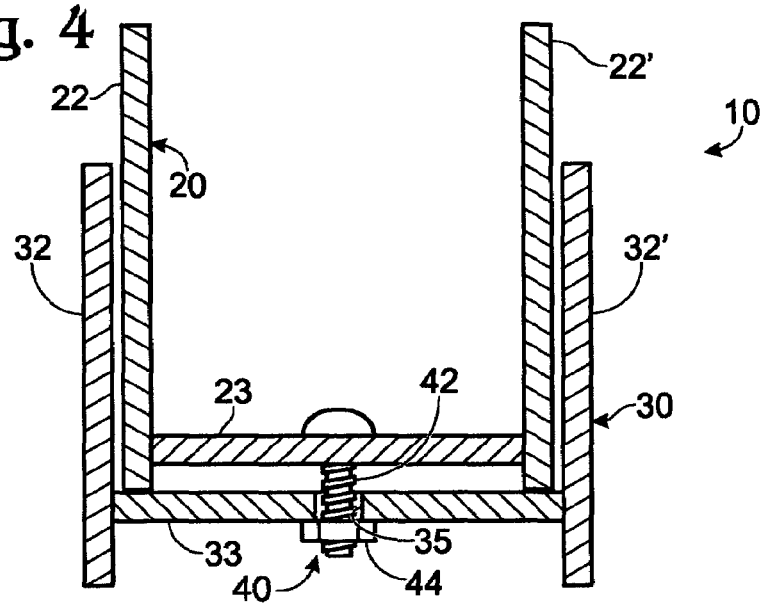
FIG. 4 is a cross-sectional view of the tray and rack assembly of the present invention taken along line 4—4 of FIG. 1.
Figure 5:
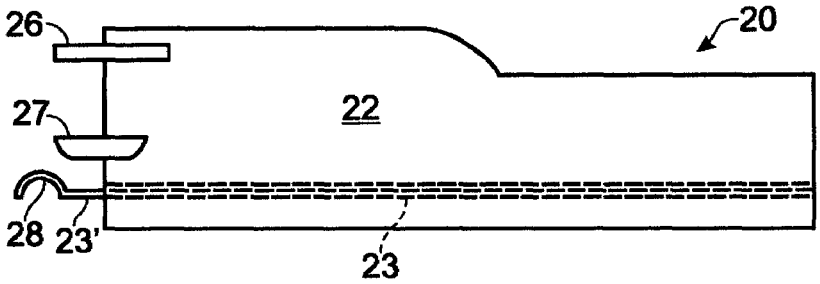
FIG. 5 is a right side elevation view of the tray subassembly of the present invention.

Tray subassembly 20 is inserted into tray subassembly 30, as seen in FIG. 1. A sliding attachment member 40, such as a bolt 42 and nut 44, are assembled as shown in FIG. 4. Bolt 42 is passed through fastener opening 29 in tray floor 23 and through slot 35 in rack floor 33, and nut 44 attached to its outer end. The head of bolt 42 is larger than sliding attachment opening 29 and nut 44 is larger than the width of slot 35. Nut 44 is not tightly attached to bolt 42 in order to allow some play between tray 20 and rack 30, and to allow tray 20 to be extended from rack 30 as shown in FIG. 2.

In operation, the tray and rack assembly 10, as shown in FIG. 1, is placed on the shelf of a refrigeration unit so that the outer (front) end of assembly 10 is lower than the inner (rear) end thereof. Tray pull 28 is grasped, and tray 20 lifted slightly to disengage contact between the lower edges of tray sidewalls 22, 22' and tray stop 34'. Tray 20 is then pulled outwardly until sliding attachment member 40 abuts the outer end of slot 35, i.e., to the position shown in FIG. 2. Tray 20 is then filled with beverage containers and pushed back into rack 30 until the lower edges of tray sidewalls 22, 22' engage tray stop 34'.

Figure 11:
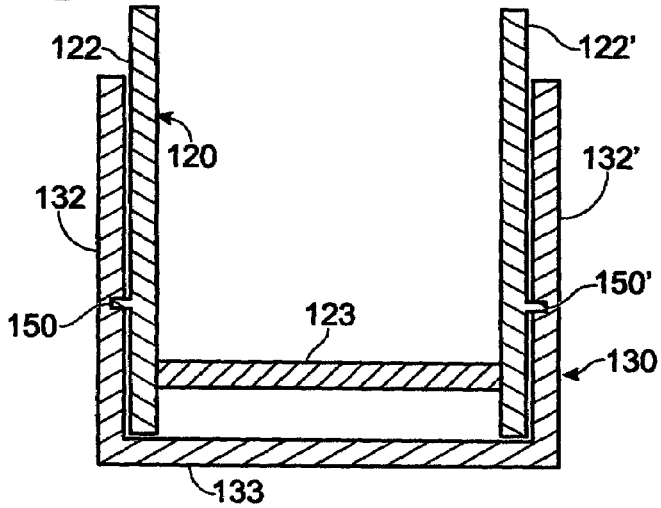
FIG. 11 is a cross-sectional view of an alternative sliding connection for the tray and rack assembly of the present invention.

An alternative embodiment of the sliding attachment means is shown in FIG. 11 where parts identical to those in FIGS. 1–10 have the same reference number but increased by 100. Sliding attachment means 40 is replaced with a pair of right and left longitudinal flanges 150, 150' extending outwardly from right and left tray sidewalls 122, 122' of tray 120. Flanges 150, 150' are slidingly seated in opposing longitudinal slots located in the inner surface of right and left rack sidewalls 132, 132', respectively.

It will be obvious to those having skill in the art that many changes may be made to the details of the above-described embodiments of this invention without departing from the underlying principles thereof. The scope of the present invention should, therefore, be determined only by the following claims.

What is claimed is:

1. A tray and rack assembly for beverage containers comprising:

a tray subassembly including a pair of substantially parallel tray sidewalls having upper and lower edges and inner and outer ends, a tray floor having inner and outer ends, said tray floor extending between the lower edges of said tray sidewalls, at least one beverage container stop member extending at least partially between said outer ends of said tray sidewalls, and a tray pull member extending from the outer end of said tray;

a rack subassembly including a pair of substantially parallel rack sidewalls having upper and lower edges and inner and outer ends, a rack floor having inner and outer ends, said rack floor extending between the lower edges of said rack sidewalls, an end wall extending between the inner ends of said rack sidewalls, and a tray stop member extending located adjacent the outer end of said rack; and sliding attachment means adapted to hold said tray in sliding contact with said rack and permit said tray to be extended from and inserted into said rack.

2. The tray and rack assembly of claim 1 wherein said tray floor has an upper surface with a plurality of longitudinal rails extending therefrom.

3. The tray and rack assembly of claim 2 wherein said tray floor has a plurality of weep holes extending therethrough.

4. The tray and rack assembly of claim 1 wherein said tray pull member extends from the outer end of said tray floor.

5. The tray and rack assembly of claim 1 wherein said tray stop member extends upwardly from the outer end of said rack floor.

6. The tray and rack assembly of claim 1 wherein said rack floor extends between said rack sidewalls adjacent their bottom edges, but removed therefrom, and said sliding attachment means includes a longitudinal slot extending through said rack floor and a sliding attachment member extending from the bottom of said tray floor and into sliding engagement with said longitudinal slot.

7. The tray and rack assembly of claim 6 wherein said sliding attachment member is a threaded fastener.

8. The tray and rack assembly of claim 7 wherein said threaded fastener is a bolt passing through a sliding attachment opening in said tray floor and through said longitudinal slot, a nut being attached to the end of said bolt extending through said longitudinal slot.

9. The tray and rack assembly of claim 8 wherein said threaded fastener opening is located adjacent the inner end of said tray floor.

10. The tray and rack assembly of claim 1 wherein said sliding attachment means includes a flange extending outwardly from each of said tray sidewalls, said flanges adapted to slidingly engage opposing slots located in each of said rack sidewalls.

* * * * *